US007046211B1

(12) United States Patent
Wang

(10) Patent No.: US 7,046,211 B1
(45) Date of Patent: May 16, 2006

(54) INDOOR ANTENNA

(75) Inventor: Cheng-Si Wang, Changhua Hsien (TW)

(73) Assignee: Trans Electric Co., Ltd., Changhua Hsien (TW)

( * ) Notice: Subject to any disclaimer, the term of this patent is extended or adjusted under 35 U.S.C. 154(b) by 0 days.

(21) Appl. No.: 11/030,167

(22) Filed: Jan. 7, 2005

(51) Int. Cl.
*H01Q 1/12* (2006.01)

(52) U.S. Cl. ..... 343/880; 343/892

(58) Field of Classification Search ..... 343/805, 343/820–823, 878, 880, 888, 702, 892
See application file for complete search history.

(56) References Cited

U.S. PATENT DOCUMENTS 2,872,677 A * 2/1959 Whipple et al. ..... 343/702
3,056,925 A * 10/1962 Borck et al. ..... 343/703

* cited by examiner

*Primary Examiner*—Michael C. Wimer
(74) *Attorney, Agent, or Firm*—Rabin & Berdo, P.C.

(57) ABSTRACT

An indoor antenna includes a rectangular receiving board with four edges. Two fastening members are respectively provided at two adjacent edges of the receiving board and perpendicular to each other. A seat has a bottom plate. A supporting member is formed on the bottom plate and engaged in one of the two fastening members for positioning the receiving board on the seat. Whereby, the antenna can receive vertical or horizontal signals by inserting the supporting member into the corresponding fastening member.

6 Claims, 6 Drawing Sheets

INDOOR ANTENNA

BACKGROUND OF THE INVENTION

1. Field of the Invention

The present invention relates to an indoor antenna, and more particularly to an indoor antenna of which a receiving board detachably installed on a base has alternative installing manners for receiving vertical and horizontal signals.

2. Description of Related Art

A conventional indoor antenna generally includes a base and a receiving board fixedly mounted on the base. The conventional antenna only has a high sensitivity for receiving vertical signals, and can not receive clear horizontal signals. Therefore, a user must adjust the antenna to a proper angle, and even rest the antenna at a horizontal position, for receiving the horizontal signals. However, it is very inconvenient to so adjust the antenna.

Therefore, the invention provides an indoor antenna to mitigate or obviate the aforementioned problems.

SUMMARY OF THE INVENTION

The main objective of the present invention is to provide an indoor antenna of which a receiving board has alternative installing manners for respectively receiving vertical and horizontal signals.

Other objectives, advantages and novel features of the invention will become more apparent from the following detailed description when taken in conjunction with the accompanying drawings.

DETAILED DESCRIPTION OF THE PREFERRED EMBODIMENT

With reference to FIGS. 1–4, an indoor antenna in accordance with the present invention is composed of a receiving board (10*a*) and a seat (20*a*).

The receiving board (10*a*) for receiving digital signals has a rectangular shape with a front side (11*a*) and a rear side (12*a*). A coaxial-cable connector (121*a*) and a power jack (122*a*) are provided at the rear side (12*a*). Two fastening members (15*a*) are respectively formed at two adjacent edges of the rear side of the receiving board (10*a*). Each of the fastening members (15*a*) has a pair of ears (151*a*), and a pair of channels (152*a*) respectively defined in the ears (151*a*). The channels (152*a*) each have an open end adjacent the respective edges and a closed end away from the respective edges. The channels (152*a*) of one of the fastening members (15*a*) are perpendicular to the channels (152*a*) of the other fastening member (15*a*).

The seat (20*a*) has a bottom plate (21*a*) and a bracket (22*a*) formed on the bottom plate (21*a*). The bracket (22*a*) has a vertical sheet which can be inserted in the channels (152*a*) for installing the fastening members (15*a*) on the seat (20*a*).

Figure 1:
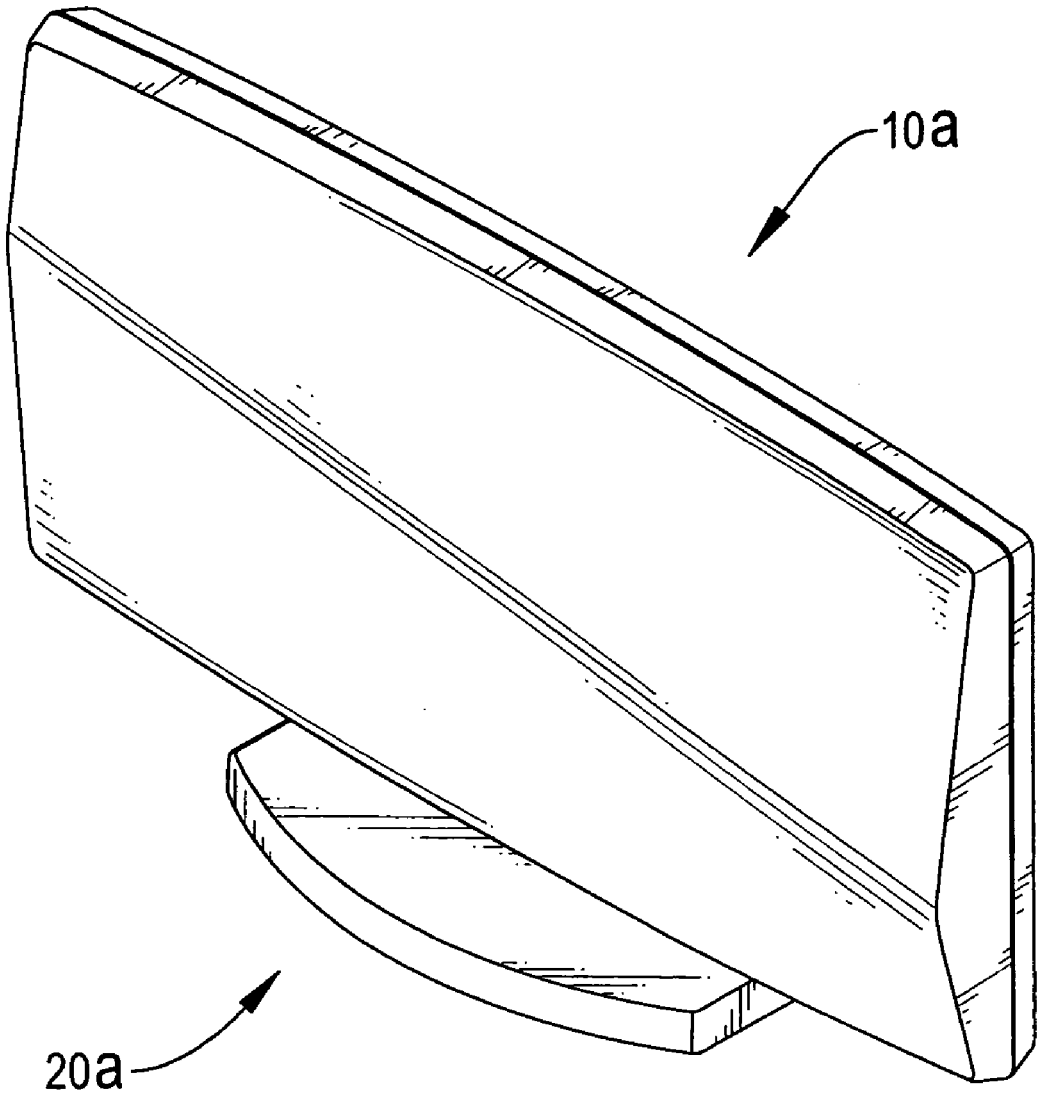
FIG. 1 is a perspective view of an indoor antenna in accordance with the present invention.
Figure 2:
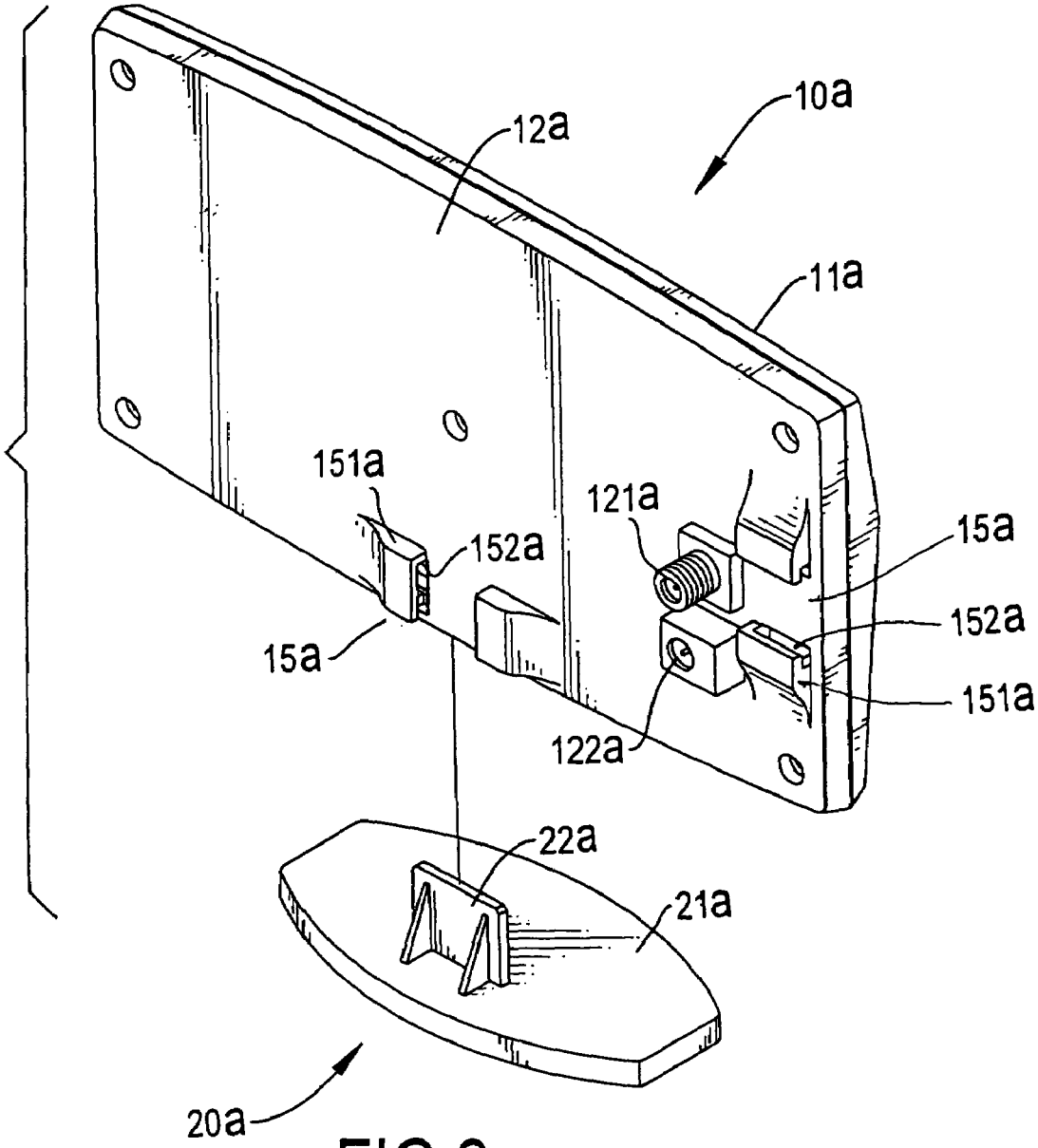
FIG. 2 is an exploded perspective view of the indoor antenna.
Figure 3:
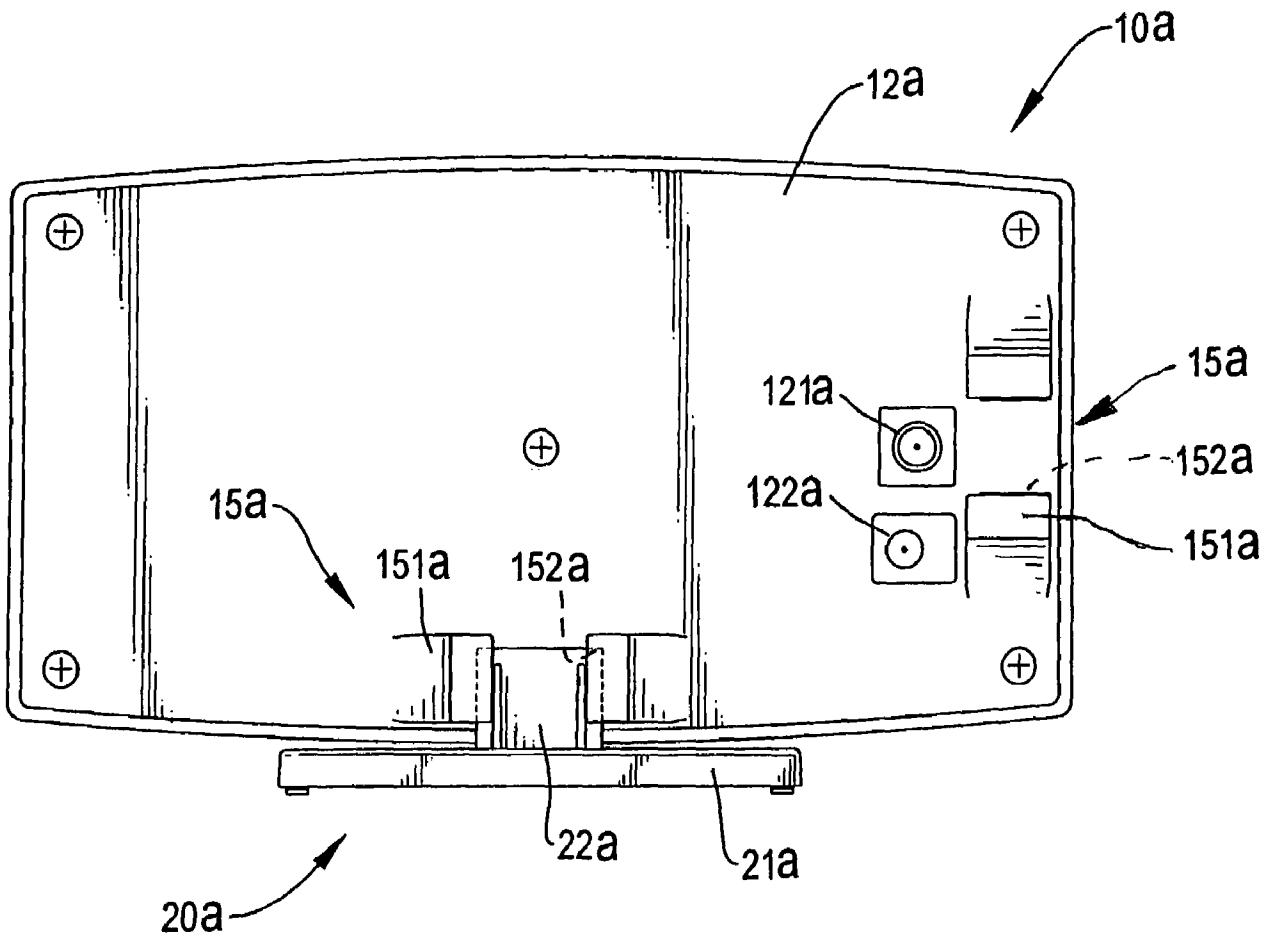
FIG. 3 is a rear view of the indoor antenna assembled in a first manner.
Figure 4:
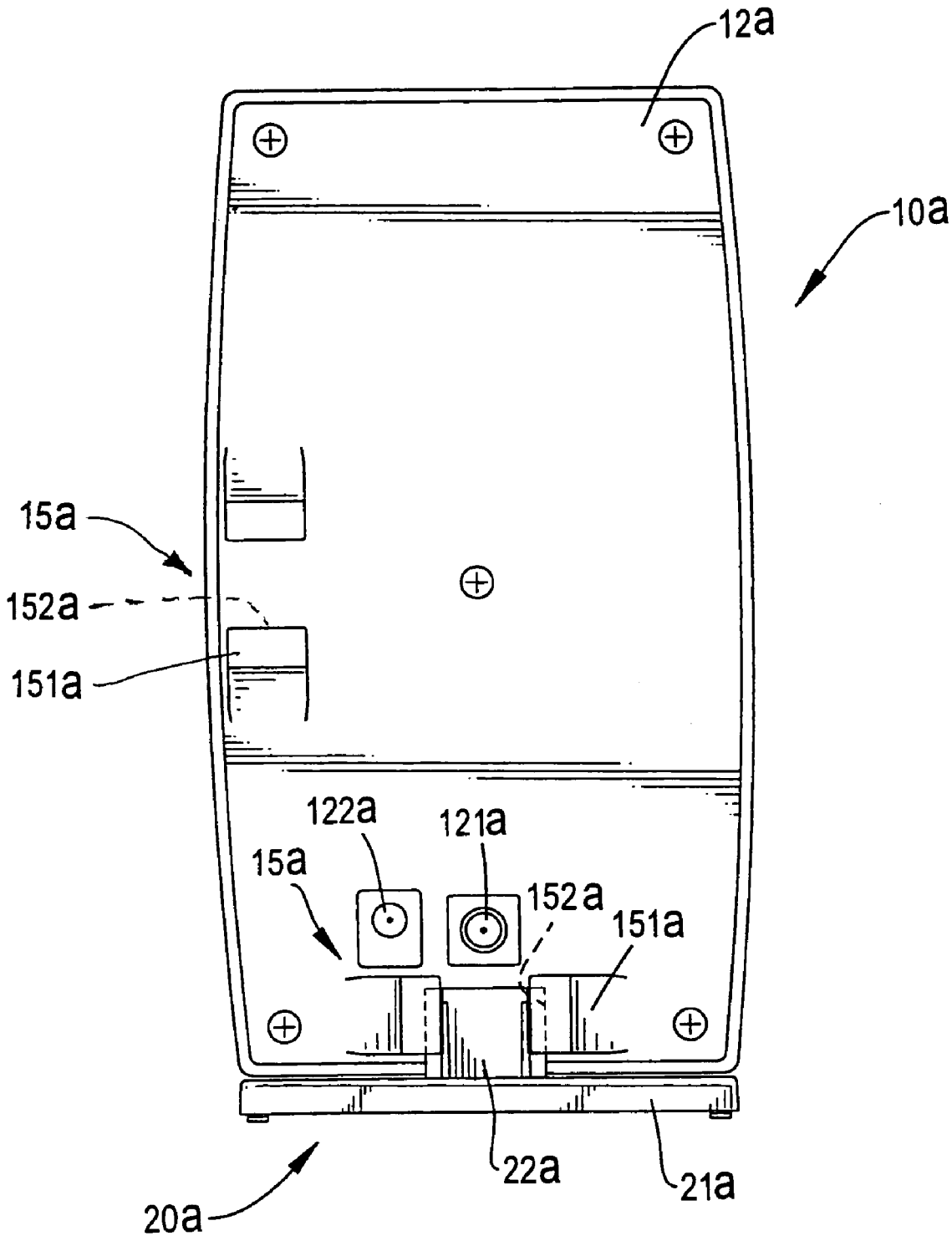
FIG. 4 is a rear view of the indoor antenna assembled in a second manner.

With reference to FIG. 3, when the bracket (22*a*) is inserted in the channels (152*a*) at the long edge of the receiving board (10*a*), the receiving board (10*a*) is arranged for receiving vertical signals. With reference to FIG. 4, when the bracket (22*a*) is inserted in the channels (152*a*) at the short edge of the receiving board (10*a*), the receiving board (10*a*) is arranged for receiving horizontal signals.

Figure 5:
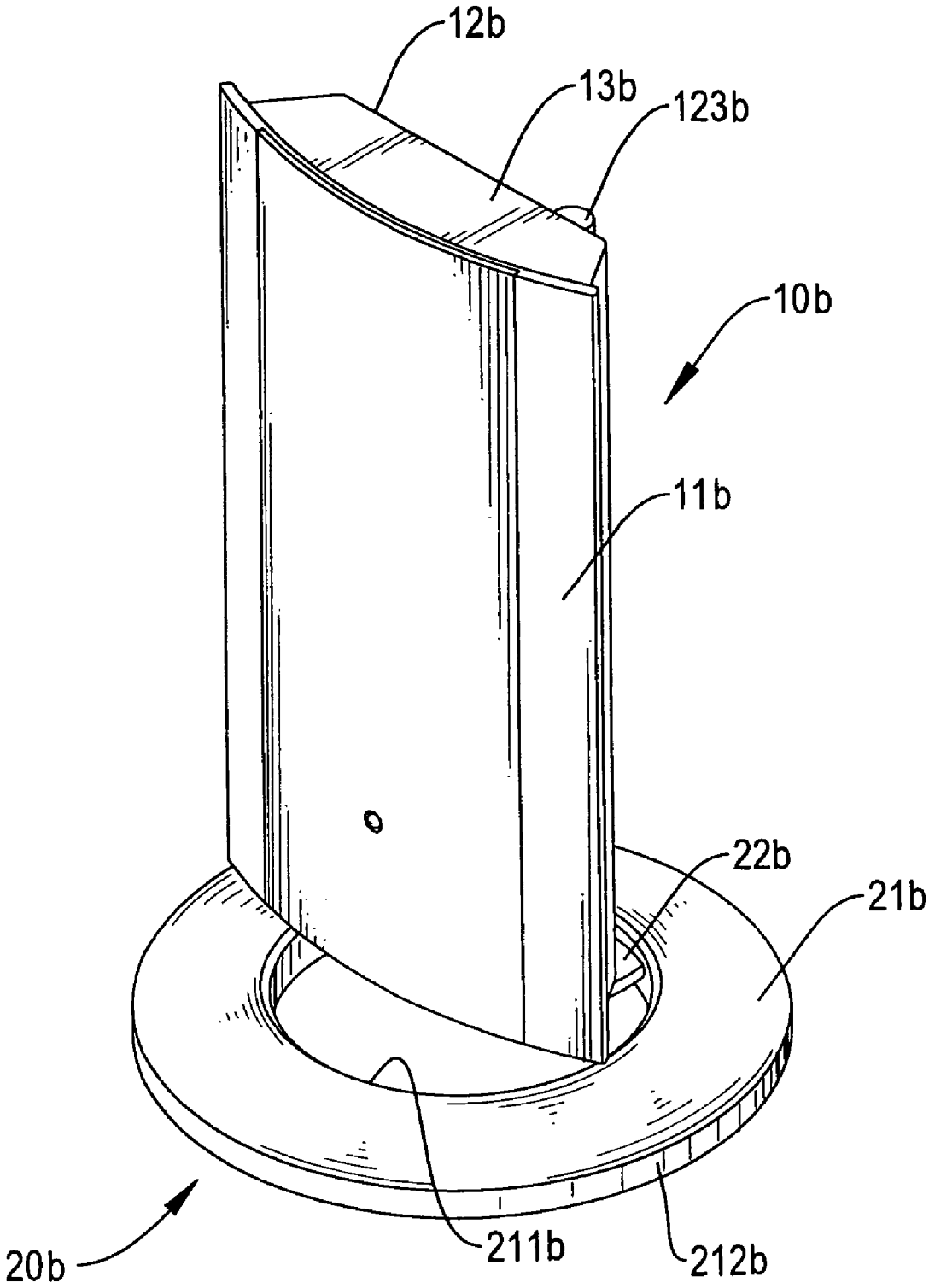
FIG. 5 is a perspective view of another embodiment of the indoor antenna in accordance with the present invention.
Figure 6:
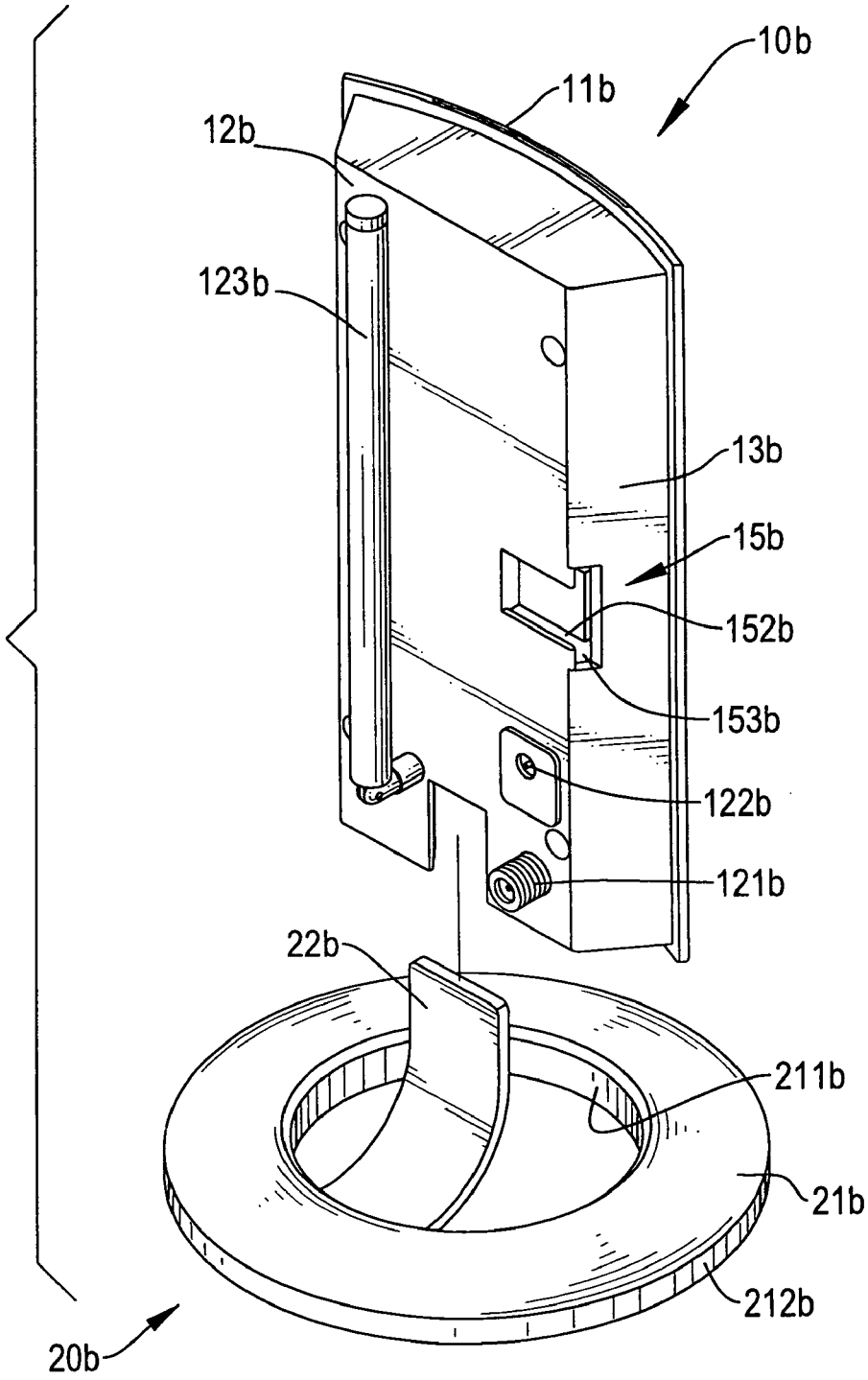
FIG. 6 is an exploded perspective view of the indoor antenna in FIG. 5.

With reference to FIGS. 5 and 6, in another embodiment of the invention, the antenna includes a seat (20*b*) and a receiving board (10*b*). The receiving board (10*b*) for receiving digital signals has a rectangular shape with a cambered front side (11*b*), a planar rear side (12*b*), and peripheral sides (13*b*) between the front side (11*b*) and rear side (12*b*). A coaxial-cable connector (121*b*) and a power jack (122*b*) are provided at the rear side (12*b*). A telescopic antenna (123*b*) is provided at the rear side (12*b*) for receiving analog signals. Two fastening members (15*b*) are respectively provided at two adjacent edges of the rear side (12*b*). Each of the fastening members (15*b*) has a pair of channels (152*b*) defined in the rear side (12*b*) and each channel (152*b*) has an open end (153*b*) defined at the respective peripheral side (13*b*). The pair of channels (152*b*) of one side are perpendicular to the channels of the other side.

The seat (20*b*) has a ring (21*b*) with an outer circumference (212*b*) and an inner circumference (211*b*), and a finger (22*b*) with a free end extending upwards from the inner circumference (211*b*). The finger (22*b*) can be inserted in one of the two pairs of channels (152*b*) to mount the receiving board (10*b*) on the seat (20*b*).

Therefore, by inserting the bracket (22*a*) or finger (22*b*) into one of the two pairs of channels (152*a*, 152*b*), the receiving board (10*a*, 10*b*) can be disposed with two statuses for respectively receiving vertical signals or horizontal signals.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An indoor antenna comprising:

a rectangular receiving board with four edges;

two fastening members respectively provided at two adjacent edges of the receiving board and oriented perpendicular to each other; and a seat having a bottom plate, and a supporting member formed on the bottom plate and selectively engagable in one of the two fastening members for positioning the receiving board on the seat;

wherein the receiving board has a front side and a rear side; the fastening members are provided at the rear side of the receiving board; each fastening member comprises a pair of channels respectively defined in the rear side; one pair of the channels is perpendicular to the other pair of channels; and each channel has an open end adjacent the respective edge and a closed end away from the respective edge.

2. The indoor antenna as claimed in claim 1, wherein each fastening member comprises a pair of ears to define the pair of channels between the pair of ears; and the supporting member has a bracket with a vertical sheet selectively insertable in one of the two pairs of channels to position the receiving board on the seat.

3. The indoor antenna as claimed in claim 1, wherein the seat has a ring with an outer circumference and an inner circumference, and a finger with a free end extending upwards from the inner circumference of the ring and respectively insertable into one of the two pairs of channels.

4. The indoor antenna as claimed in claim 3 wherein the front side is cambered, and the rear side is planar.

5. The indoor antenna as claimed in claim 1 thrther comprising a telescopic antenna provided on the receiving board.

6. The indoor antenna as claimed in claim 1, wherein the receiving board has a coaxial-cable connector and a power jack provided on the receiving board.

* * * * *